US006889648B2

(12) United States Patent
Koch et al.

(10) Patent No.: US 6,889,648 B2
(45) Date of Patent: May 10, 2005

(54) INTAKE SYSTEM FOR AN INTERNAL COMBUSTION ENGINE

(75) Inventors: Ingo Koch, Steinheim-Kleinbottwar (DE); Achim Rehmann, Kieselbronn (DE)

(73) Assignee: Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/706,293

(22) Filed: Nov. 13, 2003

(65) Prior Publication Data

US 2004/0149248 A1 Aug. 5, 2004

(30) Foreign Application Priority Data

Nov. 13, 2002 (DE) ..... 102 52 784

(51) Int. Cl.[7] ..... F02M 35/10
(52) U.S. Cl. ..... 123/184.47; 123/184.55
(58) Field of Search ..... 123/184.21–184.61

(56) References Cited

U.S. PATENT DOCUMENTS

| | | | | | |
|---|---|---|---|---|---|
| 4,664,075 | A | * | 5/1987 | Poulos | 123/184.42 |
| 5,651,338 | A | * | 7/1997 | Pacheco et al. | 123/184.34 |
| 5,813,380 | A | * | 9/1998 | Takahashi et al. | 123/184.55 |
| 6,666,182 | B2 | * | 12/2003 | Schermuly et al. | 123/184.55 |
| 6,758,182 | B2 | * | 7/2004 | Nomizo et al. | 123/184.57 |
| 2002/0144668 | A1 | | 10/2002 | Schermuly et al. | |

* cited by examiner

*Primary Examiner*—Marguerite McMahon
(74) *Attorney, Agent, or Firm*—Crowell & Moring LLP

(57) ABSTRACT

An intake system for an internal combustion engine having an intake plenum and at least one intake pipe which branches off from the intake plenum and which is composed of at least two intake pipe parts that are divided longitudinally. The intake plenum together with one of the intake pipe parts forms a single integral base part. The second intake pipe part is configured as an interchangeable insert that also forms one wall shell of the intake plenum.

8 Claims, 1 Drawing Sheet

INTAKE SYSTEM FOR AN INTERNAL COMBUSTION ENGINE

BACKGROUND OF THE INVENTION

The present invention relates to an intake system for an internal combustion engine with an intake plenum for combustion air and at least one intake pipe which branches off from the intake plenum.

Published U.S. Patent Application No. 2002/0144668 (=DE 199 44 855) discloses an intake device for an internal combustion engine that has a plurality of intake pipes, each of which is associated with one cylinder of the internal combustion engine, and a common intake plenum for the intake pipes through which the intake pipes are supplied with combustion air. Each intake pipe is made of three parts: a first intake pipe part on the cylinder head side and a second intake pipe part joined to the intake plenum are each divided longitudinally and are supplemented in a complementary manner by a central intake pipe part. This central intake pipe part is interchangeable, such that modifying the intake pipe geometry of this part makes it possible to adjust the intake pipe to have different overall lengths. This provides a simple means to adapt the length of the intake pipe to different internal combustion engines while retaining the geometry of the intake plenum.

SUMMARY OF THE INVENTION

It is an object of the present invention to provide an improved air intake system for an internal combustion engine.

Another object of the invention is to provide an air intake system which is highly compact.

A further object of the invention is to provide an air intake system which can be easily adapted to different internal combustion engines.

These and other objects are achieved in accordance with the present invention by providing an intake system for an internal combustion engine comprising an intake plenum into which combustion air is to be introduced, and at least one intake pipe which branches off from the intake plenum and comprises at least two longitudinally divided intake pipe parts, wherein the intake plenum and one of the intake pipe parts together form a single integral base part, and a second intake pipe part is configured as an interchangeable insert that forms one wall shell of the intake plenum.

Advantageous further refinements are also described hereinafter.

In the intake system according to the invention, each intake pipe is divided longitudinally, such that at least two intake pipe parts are formed along a longitudinal pipe plane. The intake plenum together with one of the intake pipe parts forms an integral, one-piece base part while the other intake pipe part is configured as an interchangeable insert that forms one wall shell of the intake plenum.

The base part can be constructed identically for different engine variants, whereas the interchangeable insert can be adapted to the respective requirements of a given engine, particularly with regard to the size and performance data of the engine. Due to the construction of the one intake pipe part in one-piece with a wall section of the intake plenum, a particularly compact overall volume is achieved. In particular, an intake pipe part and a wall portion of the intake plenum can be constructed as a single integral part and can be produced, for example, as a combined synthetic resin (i.e., plastic) component in an injection molding process.

By using an interchangeable intake pipe part having a modified geometry, it is possible to realize different intake pipe lengths or intake pipe volumes that are adapted to the respective internal combustion engine. The remaining intake pipe parts and the remaining wall sections of the intake plenum—the base part—can be kept unchanged. On the one hand this reduces the variety of parts and thus also the tooling costs, while on the other hand the structural shape and size of the intake system are essentially retained.

During assembly, the intake pipe part that forms the interchangeable insert can be permanently and non-detachably connected to the base part by welding. Where applicable, however, a detachable joint may also be considered.

In one particularly advantageous embodiment, one end of the interchangeable intake pipe part projects into the interior of the intake plenum. The length of this projecting intake pipe end, which is an integral component of the interchangeable intake pipe part, determines the overall length of the intake pipe. As a result, it is basically sufficient to configure the intake pipe parts with pipe ends of different lengths in order to vary the total length of the intake pipe and thus to adapt it to different internal combustion engines. The pipe end projecting into the intake plenum does not take up any additional volume, so that a particularly compact overall configuration is achieved.

On the pipe end, a radially projecting stop can be provided, which is supported against the inside wall of the intake plenum when the interchangeable intake pipe part is installed. This arrangement facilitates mounting on the one hand and enhances the air-tightness of the joint between the interchangeable intake pipe part and the intake plenum. If desired, a sealing element may be arranged between the stop and the inside wall of the intake plenum.

Advantageously, the interchangeable intake pipe part forms an upper shell of the intake pipe and the wall part connected with the interchangeable pipe part forms a cover shell for the intake plenum. It is also possible, however, to make the lower shell of the intake pipe interchangeable, in which case it may be advantageous if only one sidewall of the intake plenum is formed as an integral part together with the lower shell. In principle, however, it is also possible to construct the box-like intake plenum together with the lower shell as a single interchangeable component.

BRIEF DESCRIPTION OF THE DRAWINGS

The invention will be described in further detail hereinafter with reference to illustrative preferred embodiments shown in the accompanying drawing figures in which.

In the figures, like components are identified by the same reference numerals.

DETAILED DESCRIPTION OF PREFERRED EMBODIMENTS

Figure 1:
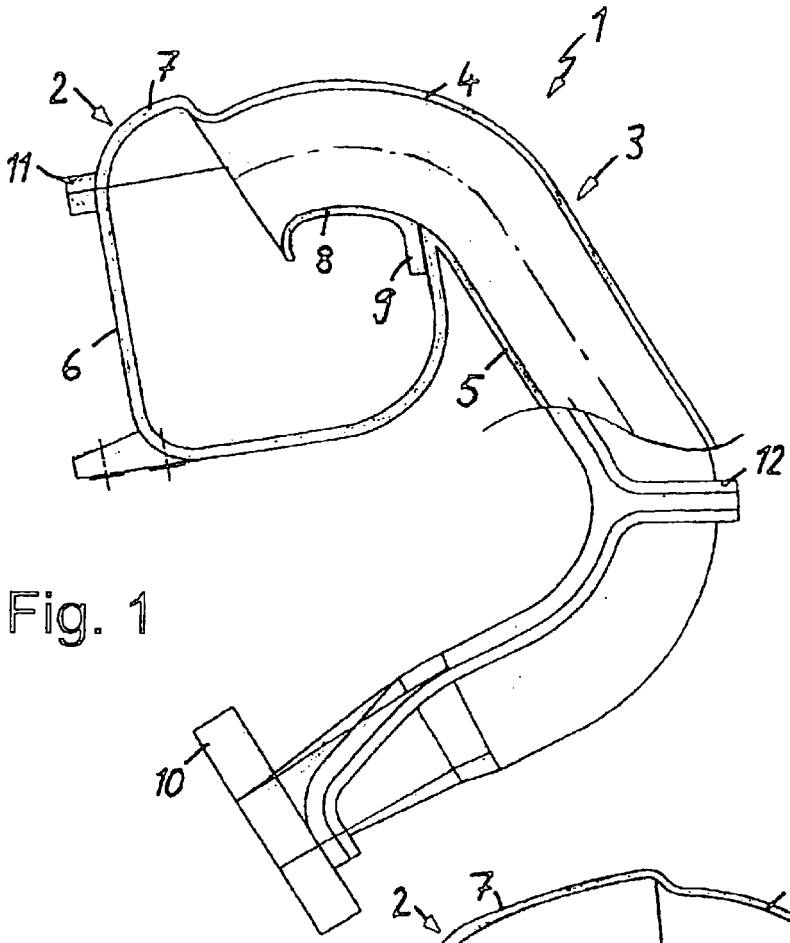
FIG. 1 is a sectional view of an intake system for an internal combustion engine with a two-part intake pipe and an intake plenum, such that an interchangeable intake pipe part and a cover shell of the intake plenum form a common component and a pipe end formed on this intake pipe part projects into the interior of the intake plenum.

The intake system 1 for an internal combustion engine depicted in FIG. 1 comprises an intake plenum 2 and a plurality of intake pipes 3 branching off from the intake plenum 2. For simplicity of illustration, however, FIG. 1 shows only a single one of these intake pipes 3 in cross section. The intake pipes extend to the cylinder inlets of the internal combustion engine and are fastened to the cylinder head of the internal combustion engine via a flange 10.

Both the intake plenum 2 and each of the intake pipes 3 are made in two parts. Each intake pipe 3 is divided longitudinally and comprises two intake pipe parts 4 and 5. In the illustrated embodiment, the upper intake part 4 forms an interchangeable upper shell, while the lower intake part 5 forms a fixed lower shell. The intake plenum 2 comprises a box 6 and an interchangeable cover shell 7.

The cover shell 7 and the upper interchangeable or insertable intake pipe part 4 together form a single integral component. The box 6 of the intake plenum 2 and the lower intake pipe part 5 (i.e., the lower shell of the intake pipe 3) also together form a single component. Intake plenum and intake pipe are advantageously produced as injection-molded synthetic resin components, such that the cover shell 7 of the intake plenum 2 and the upper intake pipe part 4 together form a common injection molded part. Likewise, the box 6 of the intake plenum and the lower intake pipe part 5 together form a common injection molded part.

The cover shell 7 and the upper intake pipe part 4, which is connected to the cover shell, are configured so as to be detachable and interchangeable and can be joined to the box 6 and the lower intake pipe part 5, respectively, with fastening means 11 or 12. The upper and lower intake pipe parts can also be joined non-detachably, e.g., by welding.

A pipe end 8 is formed integrally with the upper interchangeable intake pipe part 4. In the assembled position pipe end 8 projects into the interior of the intake plenum 2 where it expands in a flared shape at its open end. This pipe end 8 is configured as a circumferentially continuous pipe, whereas the section of the upper intake pipe part 4 lying outside the intake plenum is configured as a half shell, which is complemented by the lower intake pipe part 5 to form a common intake pipe in the assembled position.

Figure 2:
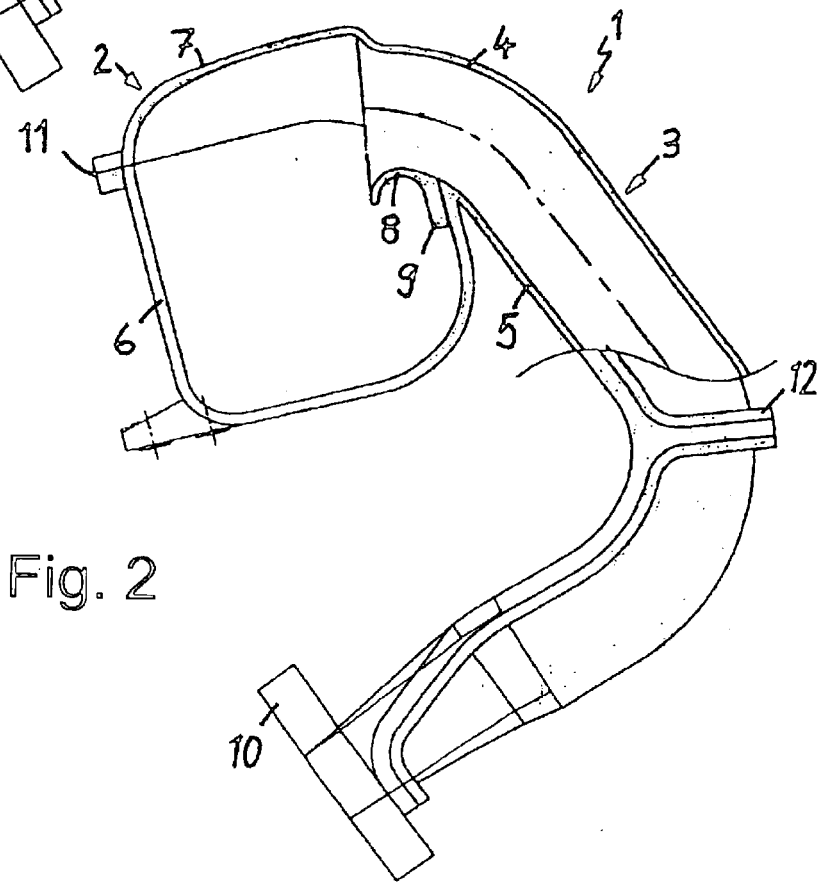
FIG. 2 is a section view of a variant comparable to FIG. 1 but with a shorter pipe end on the interchangeable intake pipe part projecting into the intake plenum.

As a comparison between FIG. 1 and FIG. 2 will show, varying the length of the pipe end 8 makes it possible to vary the total length of the intake pipe 3, while keeping the remaining geometry of the intake system unchanged.

As an alternative or in addition thereto, it may also be advantageous, however, to vary the geometry of the cover shell 7 of the intake plenum 2, again to modify the intake pipe length and/or the air volume in the intake plenum and the intake pipe. This is likewise illustrated in the drawing figures in which the cover shell geometries differ.

A stop 9, which projects radially outwardly from the outside wall of the pipe end, is formed integrally with the pipe end 8. When the parts are assembled, stop 9 overlaps with and contacts the inside wall of the box of the intake plenum 2. Stop 9 both serves as an assembly aid and facilitates sealing between the pipe end and the plenum box.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. An intake system for an internal combustion engine comprising an intake plenum into which combustion air is to be introduced, and at least one intake pipe which branches off from the intake plenum and comprises at least two longitudinally divided intake pipe parts, wherein the intake plenum and one of the intake pipe parts together form a single integral base part, and a second intake pipe part is configured as an interchangeable insert that forms one wall shell of the intake plenum.

2. An intake system according to claim 1, wherein said one wall shell forms the cover shell of the intake plenum.

3. An intake system according to claim 1, wherein the interchangeable insert comprises a pipe end which projects into the interior of the intake plenum.

4. An intake system according to claim 3, wherein a radially projecting stop is disposed on said pipe end.

5. An intake system according to claim 4, wherein said pipe end is supported against an inside wall of the intake plenum.

6. An intake system according to claim 3, wherein different interchangeable inserts differ in the length of the projecting pipe end.

7. An intake system according to claim 1, wherein the intake plenum and the at least one intake pipe are made of synthetic resin material.

8. An intake system according to claim 1, wherein different interchangeable inserts differ in the shape of the wall shell of the intake plenum formed thereby.

* * * * *